US005353958A

United States Patent [19]

Hawkins

[11] Patent Number: 5,353,958

[45] Date of Patent: Oct. 11, 1994

[54] CARBONATED BEVERAGE DISPENSER WITH CONSTANT TEMPERATURE MIXING VALVE

[75] Inventor: John T. Hawkins, San Antonio, Tex.

[73] Assignee: The Coca-Cola Company, Atlanta, Ga.

[21] Appl. No.: 56,303

[22] Filed: Apr. 30, 1993

[51] Int. Cl.[5] ..... B67D 5/62; B67D 5/56

[52] U.S. Cl. ..... 222/54; 222/129.1; 222/146.6

[58] Field of Search ..... 222/129.1–129.4, 222/146.6, 54

[56] References Cited

U.S. PATENT DOCUMENTS

| | | | |
|---|---|---|---|
| 3,979,024 | 9/1976 | Hoppe | 222/146.6 |
| 4,520,950 | 6/1985 | Jeans | 222/129.1 |
| 5,080,261 | 1/1992 | Green | 222/146.6 |

FOREIGN PATENT DOCUMENTS

| | | | |
|---|---|---|---|
| 891881 | 3/1962 | United Kingdom | 222/146.6 |

*Primary Examiner*—Karen B. Merritt

*Attorney, Agent, or Firm*—Donald R. Comuzzi; Thomas R. Boston

[57] ABSTRACT

A carbonated beverage dispenser includes a chiller connected at an inlet to a water source and at an outlet to a cool water inlet of a mixing valve. The water source further supplies ambient temperature water to a warm water inlet of the mixing valve. The mixing valve receives the two water streams and mixes them to produce a constant temperature output water stream at an outlet. A carbonator receives the constant temperature output water stream to carbonate it. A dispensing unit including a cooling unit connects to a beverage syrup product source and the carbonator to cool the carbonated water and beverage syrup and dispense them into a suitable container, thereby forming a carbonated beverage drink. Additionally, an ice maker connects to the output of the mixing valve to receive the constant temperature output water stream to make the ice dispensed with the carbonated beverage drink.

3 Claims, 1 Drawing Sheet

CARBONATED BEVERAGE DISPENSER WITH CONSTANT TEMPERATURE MIXING VALVE

BACKGROUND OF THE INVENTION

1. Field of the Invention

The present invention relates to a carbonated beverage dispensing apparatus and, more particularly, but not by way of limitation, to a carbonated beverage dispensing apparatus that reduces the temperature of water to a constant temperature value before carbonation to ensure increased and consistent carbonation in the dispensed carbonated beverage.

2. Description of the Related Art

Typical carbonated drink dispensing systems include a carbonator that connects to a $CO_2$ source and also directly to a water supply, such as a municipal water line. The carbonator diffuses the $CO_2$ into the water to produce carbonated water. The carbonated water travels from the carbonator to a cooling device such as a cold plate or an evaporator coil type refrigeration unit which forms an ice bank. The cooling device further connects to a drink syrup source to cool both the carbonated water and the drink syrup before they are dispensed from a set of dispensing valves.

A concern relating to the operation of such carbonated drink dispensing systems is the amount of carbonation in the dispensed carbonated water. The amount by which water may be carbonated depends upon water temperature in an inverse relationship. That is, lower water temperatures allow greater carbonation, while higher water temperatures reduce carbonation.

The above-described carbonated drink dispensing systems, therefore, typically produce carbonated water having insufficient levels of carbonation because their carbonators connect directly to municipal water lines. Specifically, municipal water lines transfer heat from the surrounding air to the water resulting in the temperature of the water rising to the ambient temperature. Consequently, if ambient air temperature exceeds the temperature required for sufficient carbonation, less $CO_2$ diffuses into the water which results in the dispensed carbonated drink being "flat" (i.e. undercarbonated). As most carbonated drink aficionados are well aware, "flat" carbonated drinks taste poorly when compared to fully carbonated drinks.

Accordingly, a need exists for an improved carbonated beverage dispensing apparatus that increases both the amount and the consistency of $CO_2$ diffused into the water carbonated for dispensing with beverage syrups.

SUMMARY OF THE INVENTION

In accordance with the present invention, a carbonated beverage dispensing apparatus includes a chiller, a mixing valve, a carbonator, and a dispensing unit. The chiller connects at its inlet to a water source and at its outlet to a cool water inlet of the mixing valve. The water source further connects to a warm water inlet of the mixing valve. The mixing valve mixes the water received from the chiller with the water received from the water source to produce at its an outlet an output water stream having a constant temperature. The temperature of the output water stream remains between the temperature of the water from water source and the temperature of the water from the chiller.

The mixing valve feeds the constant temperature output water stream into the carbonator. The carbonator further connects to a $CO_2$ source to diffuse $CO_2$ into the constant temperature output water stream, thereby producing carbonated water. The carbonator delivers the carbonated water to a cooling unit housed within the dispensing unit. The cooling unit also connects to a beverage syrup source to cool both the beverage syrup and the carbonated water before they are dispensed from the dispensing unit to form the carbonated beverage.

In operation, the chiller receives water from the water source and chills that water before delivering it to the cool water inlet of the mixing valve. The mixing valve mixes the cooled water stream with the ambient temperature water stream received at its warm water inlet to produce an output water stream having a temperature below ambient temperature. Additionally, the mixing valve mixes the cooled water stream with the ambient temperature water stream such that its output water stream remains at a constant temperature. The mixing valve delivers the constant temperature output water stream to the carbonator where it is carbonated before delivery to the dispensing unit. The dispensing unit cools the carbonated water and mixes it with cooled beverage syrup to form the carbonated beverage output from the dispensing valves.

Furthermore, the constant temperature output water stream may be connected to the inlet of an ice maker. The use of the reduced temperature water in the ice maker improves its efficiency, thereby allowing an increased output of ice from the ice maker.

It is, therefore, an object of the present invention to provide a carbonated beverage dispensing apparatus that reduces the temperature of the water before carbonation so that increased carbonation of that water may be achieved.

It is another object of the present invention to provide a carbonated beverage dispensing apparatus that maintains the temperature of the water at a constant level before carbonation so that a consistent amount of carbonation may be achieved.

Still other objects, features, and advantages of the present invention will become evident to those skilled in the art in light of the following.

DETAILED DESCRIPTION OF THE PREFERRED EMBODIMENT

Figure 1:
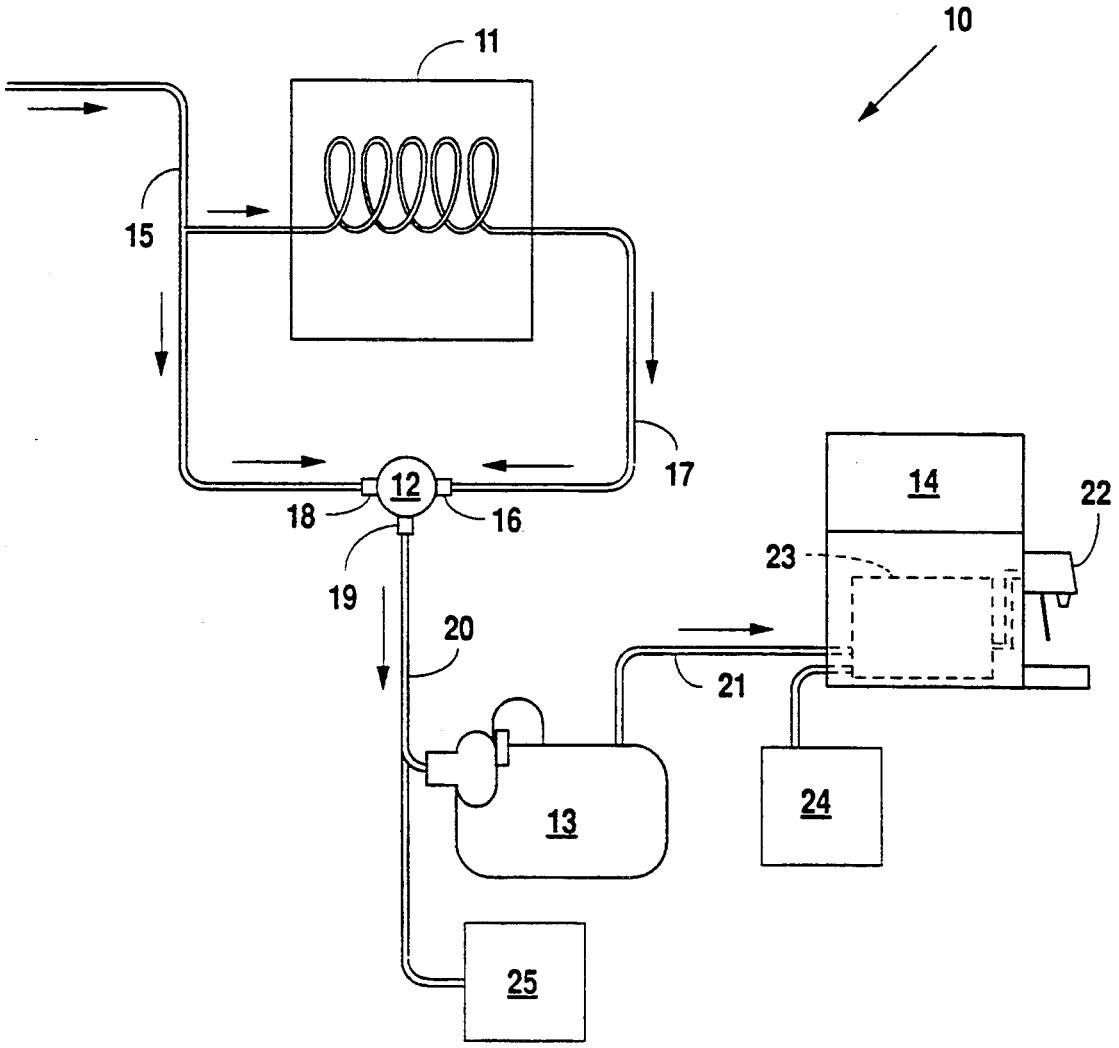
FIG. 1 is a schematic diagram depicting the carbonated beverage dispensing apparatus according to the preferred embodiment of the present invention.

As shown in FIG. 1, carbonated beverage dispensing apparatus 10 comprises chiller 11, mixing valve 12, carbonator 13, and dispensing unit 14. Chiller 11 receives water from a water source (not shown) at its inlet via water line 15. Chiller 11 may be any means to cool water such as an evaporator coil water cooling tank or a cold plate. Chiller 11 outputs the cooled water to cool water inlet 16 of mixing valve 12 via water line 17. The water source further delivers water to warm water inlet 18 of mixing valve 12 via water line 15.

In the preferred embodiment, mixing valve 12 comprises a thermostatic mixing valve which is adjustable to produce an output water stream having a specific and constant temperature below ambient water temperature. Illustratively, a Lawler series 9600 thermostatic mixing valve could be used to implement mixing valve 12. To produce an output water stream having a reduced and constant temperature at outlet 19, mixing valve 12 mixes the cooled water from chiller 11 with the ambient temperature water delivered directly from the water source. Both cool water inlet 16 and warm water inlet 18 include flow rate adjusters so that the flow rates of the two water streams input into mixing valve 12 may be adjusted. Accordingly, the output from mixing valve 12 may be adjusted to remain at a temperature between that of the cooled water and that of the ambient temperature water. That is, the flow rate adjusters are adjusted to provide an output water stream at a desired temperature, and, once that desired temperature is reached, adjustment stops so that mixing valve 12 will output the water at the desired constant temperature. Illustratively the temperature of the output water stream may be 75° Fahrenheit.

The constant temperature water, which is below the temperature of the ambient water, flows from outlet 19 to carbonator 13 via water line 20. Carbonator 13 connects to a $CO_2$ source (not shown) to carbonate the constant temperature water. Specifically, carbonator 13 introduces the $CO_2$ into the constant temperature water so that the $CO_2$ will diffuse into the water to produce carbonated water at the output of carbonator 13. Carbonator 13 delivers the carbonated water to dispensing unit 14 via carbonated water line 21.

Dispensing unit 14 includes cooling unit 23 which receives the carbonated water to reduce its temperature to below the maximum acceptable dispensing temperature of 40° Fahrenheit. Additionally, the cooling unit 23 connects to beverage syrup source 24 to cool the beverage syrup to below 40° Fahrenheit before dispensing. Cooling unit 23 in the preferred embodiment may be of any standard type such as a cold plate or an evaporator coil device which forms an ice bank. Dispensing valves 22 connect to the outlet from cooling unit 23 to pump the carbonated water and beverage syrup from the cooling unit 23 and dispense them into a suitable container.

Carbonated beverage dispensing apparatus 10 provides an improved carbonated beverage product by employing a mixing valve which produces an output water stream that has a constant temperature below ambient water temperature. The reduced temperature of the water permits carbonator 13 to diffuse additional amounts of $CO_2$ into it. As a result, the carbonated beverage dispensing apparatus eliminates the poor tasting "flat" drink normally experienced with undercarbonated products. Furthermore, the constant temperature of the water output from mixing valve 12 allows carbonator 13 to provide a consistent amount of carbonation. Thus, carbonated beverage dispensing apparatus 10 dispenses drinks having a consistent carbonation which provides drinks having a constant taste.

Finally, the reduction in water temperature before carbonation improves the drink dispensing capacity of carbonated beverage dispensing apparatus 10. Specifically, cooling unit 23 more easily maintains the carbonated water at a temperature below the required dispensing temperature because it no longer must cool the water completely from ambient temperature to the required dispensing temperature. Accordingly, there is no high temperature carbonated water to melt either the ice bank formed by the evaporator coil device or the ice over a cold plate which means that the cooling units operate more efficiently to maintain both the carbonated water and the beverage syrup at a temperature below the required dispensing temperature. Consequently, the drink foaming typically associated with a drink dispensed above the required beverage dispensing temperature is eliminated.

In an alternative embodiment, carbonated beverage dispensing apparatus 10 further includes an ice maker 25 also connected to outlet 19 of mixing valve 12 to receive the constant temperature water. Ice maker 25 provides the ice served with the dispensed carbonated beverage and, further, supplies the ice for a cold plate if it implements the cooling unit 23. Similar to the improved performance of the cooling unit 23, connecting the ice maker 25 to mixing valve 12 improves its efficiency. That is, the output of the ice maker 25 will increase because it no longer must reduce the water it receives from ambient temperature to below freezing, but, rather, it must only reduce the temperature of the water from the constant output temperature of mixing valve 12 to below freezing.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims which follow.

I claim:

1. A carbonated beverage dispensing apparatus, comprising:

a first cooling means connected at an inlet to a water source;

a mixing valve connected at a first inlet to said water source and at a second inlet to an outlet of said first cooling means, said mixing valve mixing the water received from said water source with the water received from said first cooling means to produce a constant temperature water stream at an output thereof;

a carbonator connected to said output of said mixing valve for carbonating the constant temperature water stream;

a second cooling means connected to a beverage syrup source and said carbonator for cooling the carbonated water and the beverage syrup; and a dispensing means connected to said second cooling means for dispensing the cooled carbonated water and the cooled beverage syrup to form a carbonated beverage.

2. The carbonated beverage dispensing apparatus according to claim 1, wherein said mixing valve is adjustable to produce said constant temperature output water stream in a temperature range from not less than the temperature of the water delivered from said first cooling means to a temperature of not more than the temperature of the water delivered from said water source.

3. The apparatus according to claim 1, further comprising a means for making ice connected to the output of said mixing valve to receive the constant temperature output water stream.

* * * * *

UNITED STATES PATENT AND TRADEMARK OFFICE

CERTIFICATE OF CORRECTION

PATENT NO. : 5,353,958

DATED : Oct. 11, 1994

INVENTOR(S) : John T. Hawkins et al.

It is certified that error appears in the above-identified patent and that said Letters Patent is hereby corrected as shown below:

On the title page, item "[75] Inventor:", after "Tex.", insert --Samuel Durham, San Antonio, Tex., and Ronald L. Wiley, Marietta, Ga.--.

Signed and Sealed this

Nineteenth Day of December, 1995

*Attest:*

Bruce Lehman

BRUCE LEHMAN

*Attesting Officer*

*Commissioner of Patents and Trademarks*